United States Patent [19]

Winkelmann

[11] Patent Number: 4,487,009

[45] Date of Patent: Dec. 11, 1984

[54] SPINDLE CAP HAVING A VARIABLE MOMENT OF RESISTANCE

[75] Inventor: Adalbert Winkelmann, Caluire, France

[73] Assignee: Verdol S.A., Caluire, France

[21] Appl. No.: 469,670

[22] Filed: Feb. 25, 1983

[30] Foreign Application Priority Data

Mar. 3, 1982 [FR] France ..... 82 03872

[51] Int. Cl.[3] ..... D01H 7/86; D01H 1/10; D01H 13/10

[52] U.S. Cl. ..... 57/58.86; 57/113; 57/116; 242/128

[58] Field of Search ..... 57/58.83, 58.86, 113, 57/115–117, 127; 242/128

[56] References Cited

U.S. PATENT DOCUMENTS

| | | | |
|---|---|---|---|
| 1,881,252 | 10/1932 | Nau-Touron | 57/113 |
| 2,163,711 | 6/1939 | Selvig | 242/128 |
| 2,241,260 | 5/1941 | Herr | 242/128 X |
| 2,366,101 | 12/1944 | Grothey | 242/128 X |
| 3,285,531 | 11/1966 | Gillison | 242/128 |
| 3,445,998 | 5/1969 | Nakahara et al. | 57/58.86 |

FOREIGN PATENT DOCUMENTS

| | | | |
|---|---|---|---|
| 41597 | 2/1933 | France | 57/116 |

*Primary Examiner*—Donald Watkins
*Attorney, Agent, or Firm*—Dowell & Dowell

[57] ABSTRACT

The present invention relates to a yarn winding spindle cap having a variable moment of resistance, the spindle cap having diametrically oppositely extending arm portions, each of the ends of which supports a vertically oriented bushing, and the opposite ends of a loop of single strand are fixed in the bushings and position the loop so that it rubs against the periphery of the bobbin with a view to braking the spindle cap as a function of the diameter of said bobbin.

2 Claims, 2 Drawing Figures

SPINDLE CAP HAVING A VARIABLE MOMENT OF RESISTANCE

The present invention relates to improvements in spindle caps, i.e. the devices placed at the top of a double twist spindle so as to slow down the advance of the yarn. Such devices are well known in the art, and it is known that rotation thereof must be decelerated by weights or springs, so that, during reeling of the bobbin, the yarn is braked.

The yarn which is to be twisted emerges from the spindle in conventional manner through a radial hole opening out through a disc on the periphery of which is established a yarn reserve before the yarn forms the conventional twisting balloon. It will be readily understood that there must be a balancing of the tensions of the yarn which appear when it leaves the radial hole in the spindle and when it enters the bore thereof. In particular, if the tension of the yarn is such that the reserve which is made on the disc is large, it may result in a capstan effect which causes an unacceptably high tension which may lead to the balloon being eliminated and even to the yarn breaking.

Of course, the tension of the yarn at constant speed of advance is also dependent on the diameter of the bobbin. When the latter is full, i.e. when it has a large diameter, the speed of advance of the yarn at this level is low, with the result that the spindle cap must have a high moment of resistance in order to regulate the tension of this yarn.

On the other hand, when the bobbin is almost completely wound off, the speed of advance is clearly higher, with the result that the moment of resistance of the spindle cap must be lower.

Devices have already been proposed which vary the moment of resistance of a spindle cap, using for example a feeler urged to abut against the periphery of the bobbin by means of a spring. The friction of the feeler on the outside of the bobbin produces a moment of resistance which varies depending on the diameter of the bobbin, the friction in question being, of course, all the greater if the diameter is large. However, such a mechanism is complicated and heavy, is difficult to position and is of high cost price.

It is an object of the improvements according to the present invention to overcome the above-mentioned drawbacks and to provide a spindle cap comprising a simple, efficient device for varying its moment of resistance as a function of the diameter of the bobbin.

According to the invention, the ends of the two arms of the spindle cap each includes a vertical bushing in each of which bushings are fixed one of the ends of a loop of an elastic funicular element of weak rigidity, which bears against the periphery of the bobbin.

The invention will be more readily understood on reading the following description with reference to the accompanying drawings, in which.

Figure 1:
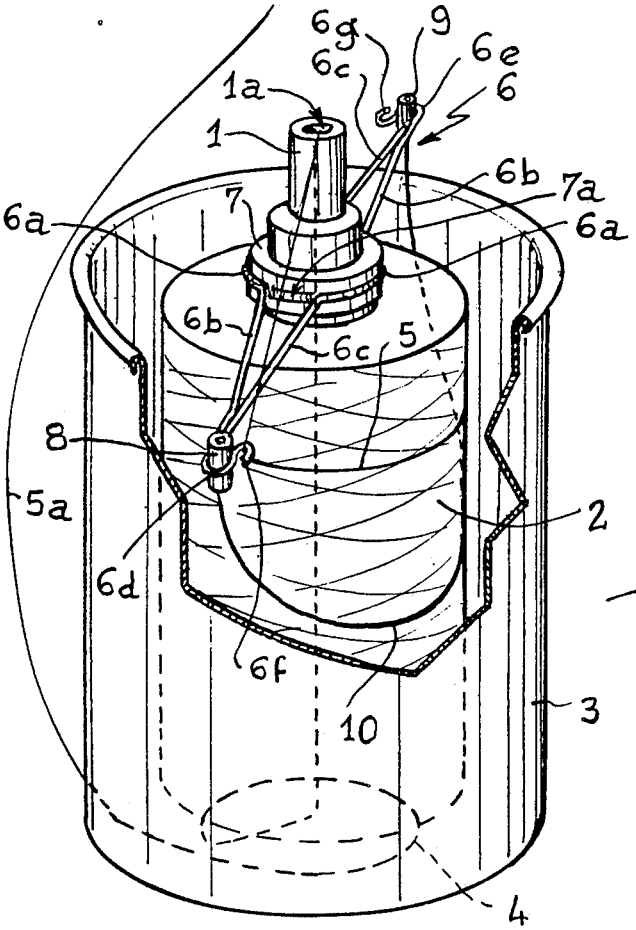
FIG. 1 is a parital view in perspective of a double twist spindle comprising a spindle cap according to the invention.

Referring now to the drawings, FIG. 1 schematically illustrates the main components of a double twist spindle comprising a rotating shape 1, provided with a central bore 1*a* with respect to which a bobbin 2 remains angularly fixed by known means, said bobbin being placed in a pot 3 of cylindrical form.

A discontinuous line illustrates the disc 4 located beneath the pot 3 and which rotates with the spindle 1. It comprises conventionally, a radial hole issuing from this bore and opening out through a peripheral area of said disc (shown only schematically). The yarn 5 coming from the bobbin 2 passes into the bore 1, passes through the radial hole in the disc 4 and forms a balloon 5*a* around the pot 3.

Two methods are in general use for regulating the tension of the yarn 5. The first consists in arranging a yarn brake inside the bore 1*a*, whilst the second is characterized by the use of a spindle cap 6 mounted to rotate freely with respect to the shaft 1 and which is associated with a device ensuring the creation of a constant or variable moment of resistance. The present invention is of the latter type.

Figure 2:
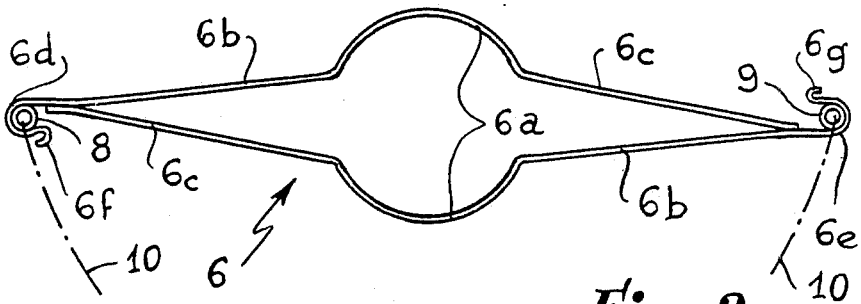
FIG. 2 is a plan view of the arms of a spindle cap equipped according to the invention.

The spindle cap 6 comprises a hub 7 mounted to rotate freely about the shaft 1. It is composed of two symmetrical arm portions of steel wire, as illustrated in FIG. 2. Each of these portions comprises a rounded central part 6*a* which encompasses the hub 7 in a groove 7*a* made therein and two arms 6*b*, 6*c* of which one of the ends comprises of hook 6*d*, 6*e*. The two portions are applied against each other and the free ends of arms 6*c* are welded against the corresponding part of the arms 6*b* so that the two central parts 6*a* of the two portions are located in the same plane.

The hooks 6*d*, 6*e* of the spindle cap 6 are each adapted to hold a bushing 8, 9 respectively, oriented perpendicularly with respect to the general plane of this spindle cap, with the result that, in practice, the busings 8, 9 are oriented vertically when the spindle cap is in place. It will further be observed that each of the hooks 6*d*, 6*e* extends into a yarn-guide 6*f*, 6*g* whose role is illustrated in FIG. 1, i.e. it serves to guide the yarn 5 between the periphery of the bobbin 2 and the bore 1*a* of the shaft 1.

In each of the bushings 8, 9 is fixed one of the ends of a loop made by an elastic funicular element of weak rigidity. This element may advantageously be composed of a strand of superpolyamide, the term strand denoting a single extruded yarn. This strand forms a loop 10 which, due to its ends being fixed in the vertical bushings 8 and 9, is in the plane of symmetry of the spindle cap when the latter is in the free state. If a material such as "Nylon" is chosen to form the loop 10, it will be readily understood that, due to its weak rigidity, if the loop 10 is offset laterally, it tends to return elastically into the plane of symmetry of the spindle cap. However, in addition, this loop has a certain suppleness which enables it, when the spindle cap is in position, to surround part of the periphery of the bobbin 2.

In this way, due to its elastic qualities and to the effect of braking due to its friction against the periphery of the bobbin, the loop 10 produces a braking of the spindle cap which is greater when the diameter of the bobbin is large than when it is small. In other words, the moment of resistance applied to the spindle cap reduces as the diameter of the bobbin 2 decreases.

It is obvious that by changing the length and diameter of the strand constituting the loop 10, the moment of resistance may be varied and adapted to the diameter and the quality of the yarn 5 wound on the bobbin 2.

A spindle cap with variable moment of resistance is thus produced whose action is particularly effective and whose cost price is very low.

It must, moreover, be understood that the foregoing description has been given only by way of example and that it in no way limits the domain of the invention whose scope would not be exceeded by replacing the details of execution described by any other equivalents.

What is claimed is:

1. In a double twist spindle of the type having a rotating shaft with a central bore extending therethrough and the shaft supporting a yarn bobbin which rotates therewith, an improved spindle cap and yarn guide comprising:

(a) a hub having a bore therethrough rotatably mounted on the spindle shaft;

(b) two arms carried by the hub and extending diametrically oppositely therefrom adjacent to the bobbin, the outer ends of the arms remote from the hub carrying yarn guide means for receiving yarn from the bobbin and guiding it to the bore in the spindle shaft; and (c) a loop comprising a funicular strand of elastic material extending from the arms and having its ends fixed thereto, the loop leaving the arms in a direction parallel to the spindle shaft and having a portion which lies in a plane normal to the spindle shaft and partially surrounds the periphery of the yarn on the bobbin and rubs thereagainst and brakes the rotation of the spindle cap with a frictional resistance that is a function of the diameter of the yarn on the bobbin.

2. An improved spindle cap as claimed in claim 1, further including two bushings fixed to the outer ends of the arms and disposed parallel to the spindle shaft; and said loop of elastic material comprising a supple single strand of superpolyamide material having its ends extending into and fixed in said bushings, the loop normally lying in a plane including the center of said shaft and said bushings but being displaced therefrom depending on the diameter of the yarn on the bobbin.

* * * * *